US006230351B1

(12) United States Patent
Kohnle

(10) Patent No.: US 6,230,351 B1
(45) Date of Patent: May 15, 2001

(54) SEAT CUSHION FOR MINIMIZING DECUBITUS ULCERS

(76) Inventor: Robert C. Kohnle, 4834 N. Interstate, Portland, OR (US) 97217

( * ) Notice: Subject to any disclaimer, the term of this patent is extended or adjusted under 35 U.S.C. 154(b) by 0 days.

(21) Appl. No.: 09/296,446

(22) Filed: Apr. 21, 1999

Related U.S. Application Data

(63) Continuation-in-part of application No. 08/823,720, filed on Mar. 25, 1997.

(51) Int. Cl.[7] ..... A47C 20/02

(52) U.S. Cl. ..... 5/690; 5/648; 5/727; 5/653

(58) Field of Search ..... 5/690, 727, 648, 5/653, 740; 297/250.1, 256.17, DIG. 1, DIG. 4

(56) References Cited

U.S. PATENT DOCUMENTS

| | | | | |
|---|---|---|---|---|
| 3,047,888 | * | 8/1962 | Shecter et al. | 5/727 X |
| 3,846,857 | * | 11/1974 | Weinstock | 5/727 X |
| 5,101,527 | * | 4/1992 | Wadsworth et al. | 5/727 X |
| 5,127,119 | * | 7/1992 | Rogers | 5/727 X |
| 5,513,402 | * | 5/1996 | Schwartz | 5/727 X |

* cited by examiner

*Primary Examiner*—B. Dayoan
*Assistant Examiner*—Fredrick Conley

(57) ABSTRACT

A seat cushion which increases the surface area contacting the patient's skin, and which conforms evenly to the skin over the skin/surface interface. A seat cushion includes a flat layer of foam that is temperature sensitive and which has rate-dependent deflection which provides maximal hysteric dampening and maximal tissue/surface interface contact. Different stiffnesses of foam are used under key areas to allow support and at the same time to allow the tissue to reach mechanical equilibrium. The maximal surface contact will apply constant low pressure to the tissues, thus reducing the shear force and the risk of tissue injury.

8 Claims, 1 Drawing Sheet

SEAT CUSHION FOR MINIMIZING DECUBITUS ULCERS

This application is a continuation in part of U.S. Ser. No. 08/823,720, filed Mar. 25, 1997 entitled MATTRESS FOR MINIMIZING DECUBITUS ULCERS

BACKGROUND OF THE INVENTION

This invention is related to the decubitus ulcer disease, and in particular to an improved seat cushion for reducing the occurrence of decubitus ulcer disease.

Decubitus ulcer disease (pressure sores) is a secondary condition which frequently occurs in elderly patients, and others whose mobility is limited. Pressure sores are a growing problem for patients, and for health care providers. Twenty percent of all patients admitted to long-term care facilities arrive with pressure sores. An additional 12% develop new sores over each subsequent six-month period. 1.7 million patients developed bedsores in 1993. The cost to treat bedsores was estimated at 8.5 billion in 1993. The number of patients requiring treatment for bedsores, and the associated costs, can be expected to increase in the coming years as the number of persons over 50 years of age increases. Patients confined to wheelchairs may also experience pressure sores as well. The persistent and increasing problem of pressure sores has prompted investigation into their causes.

Kosiak, who is referred to as the father of modern pressure sore research, defined pressure sores as localized areas of cellular necrosis. From his studies with dogs, he concluded that ischemia resulting from supracapillary pressures was one of the main causes of ulceration. Pressure ulcers were the result of ischemic, neurophic, and metabolic factors. Ulcers almost always occur in the tissue that overrides a bony prominence. When pressure exceeds tissue capillary pressure, ischemic changes result in ulceration.

Kosiak found that very high pressure over a short period of time was just as dangerous for developing ulcers as lower pressure over a longer period of time. 70 mmHg over two hours caused pathologic changes in the tissues of dogs, while 500 mmHg for two hours caused pressure sores. Kosiak's work showed that degeneration of the tissue occurs simultaneously at all levels, including the skin.

In 1930 Eugene M. Landis published a report on the Micro-Injection method for determining the blood pressure in capillaries. The method consists essentially of cannulating single capillary loops by means of a micropipette immediately adjacent to the edge of the cuticle of health individuals. 125 people were tested at the arteriolar limb, which showed a range of 21–43 mmHg with an average pressure of 32 mmHg. Nineteen people were tested at the summit of the loop, which showed a range of 18 to 32 mmHg with an average of 20 mmHg. Ninety nine people were tested at the venous limb, which show a range of 6–18 mmHg with an average of 12.3 mm Hg.

Landis further tested these individuals to determine how the capillaries would respond under stress. Stress was introduced by five methods: 1) venous congestion and capillary pressure; 2) hyperemia of heat; 3) capillary pressure in the histamine flare; 4) capillary pressure during local cooling of the skin; 5) capillary pressure after injury of the skin. Capillary response to the stresses was a uniformed increase of pressure to combat the stress, which is better known today as a compensatory response. Landis concluded that human capillary pressure varies through much wider limits than had been previously supposed. These measurements became the reference points for later research in capillary occlusion, secondary to pressure.

Disdale used pigs to study the effects of friction on the tissue and their role in the development of pressure sores. He found that friction increased the susceptibility to the skin ulceration at a constant pressure of less than 500 mm Hg but that friction and repetitive pressure of only 45 mm Hg also resulted in skin ulceration. He found that decubitus ulcers were not totally the result of an ischemic mechanism but that friction was a factor in the pathogenesis of ulcerations because it applies mechanical forces in the tissues.

Research by Keane supported the fact that ischemic muscle necrosis, due to pressure, occurs before skin death. This finding was further supported by the research of Daniel, Priest, and Wheatley. These investigators found that the pathological changes were initially in the muscle, which then progressed toward the skin with increased pressure and/or prolonged duration.

Vistnes used pigs to study the pressure gradients from the bony surfaces within the tissue out to the surface of the skin. He believed that the highest pressure was located at the bony surface and that all ulcers started at the bone and worked out. A force exerted on a small-area internal bony prominence will produce a large pressure near the bone, while the same force transmitted to the larger area of the underlying skin with produce a smaller pressure.

Czerniecki studied the effects of increased skin loading on local circulation over both soft tissue and bone in humans. Three groups were studied: young, healthy populations; older healthy populations; and peripheral vascular disease populations. Transcutaneous oxygen tension was measured while pressure was applied to the electrode. Measurements were done on the amount of pressure applied, the amount of tissue displacement that took place, and the oxygen tension when local circulation was reduced to zero.

The work of all these researchers supports the conclusion that the subcutaneous tissue pressure is related to both the magnitude and direction of the externally applied load, and to the mechanical characteristics of the tissue. Therefore, when studying the effect of loads on tissue perfusion, it is desirable to measure both the applied load and the mechanical characteristics of the tissue.

As a result of this considerable body of research, it has been found that the primary factors associated with the occurrence of pressure sores are high, localized skin pressure, and friction forces on the skin. Skin pressure above a certain level impedes micro-circulation through the subcutaneous capillaries, and thereby impedes the flow of oxygen and nutrients to skin tissues. If the high skin pressure is not relieved, the skin break will down and pressure sores will develop, opening the body to infection.

Krouskop has researched the development of interfacing surfaces to reduce tissue stress in both sitting and lying positions. He evaluated the factors affecting the pressure-distributing properties of foam mattress overlays. He reported that mattresses support the human body through either the development of mechanical equilibrium between the body of given total weight or by resistance to deformation increasing with the depth of penetration of the supported body. Although the weight of the body deforming a mattress or overlay is constant, the applied pressure at the body/mattress interface changes with increasing area of contact. For this reason, minimum average pressure is achieved with maximum envelopment of the body by the mattress. Krouskop went on to compare different types of foams by use of a spherically shaped indentor to evaluate the load-bearing capacity of the foam and then compares these pressures to pressures generated in clinical settings. Krouskop understood that pressures can be reduced by increasing surface area contact, and arrived at 32 mm Hg as the maximum permissible pressure. Until now, it has been thought that the incidence and severity of pressure sores can only be reduced if high skin pressures of 32 mmHg are avoided.

As a result, there remains a need for an improved interfacing material which can be readily adapted for use on a seat cushion, and which can effectively reduce the occurrence of pressure sores.

SUMMARY OF THE INVENTION

Applicant has discovered that contrary to the teachings of the prior art, increased surface area contact will permit the tissues to withstand higher contact pressures than previously thought, so long as the supporting force is equally applied to the body tissues in contact with the mattress. Up until now, however, there has not been a suitable seat cushion formed from a solid interfacing material which can effectively maximize the contact surface area, and thereby minimize the occurrence of bedsores. Seat cushions comprising egg crate foam overlayed atop a mattress relieve skin pressure on portions of the patient's skin, but not at all points on the patient's body sufficiently to prevent capillary occlusion. Seat Cushions overlain with egg crate materials may, in fact, cause higher localized skin pressures, since the patient's weight is being supported on a reduced overall surface area.

The present invention is embodied in a seat cushion which increases the surface area contacting the patient's skin, and which conforms evenly to the skin over the skin/surface interface. Specifically, a scat cushion according to the present invention comprises a flat layer of foam that is temperature sensitive and the deflection is which is rate dependent, i.e., the seat cushion resistance to deformation decreases with increased depth, thus allowing maximal hysteric dampening and maximal tissue/surface interface contact. Different stiffnesses of foam are used under key areas to allow support, which at the same time will allow the tissue to reach mechanical equilibrium. The maximal surface contact will apply constant low pressure to the tissues, thus reducing the shear force and the risk of tissue injury. These and other features of the invention will be discussed with reference to the drawings.

DETAILED DESCRIPTION OF THE INVENTION

Figure 1:
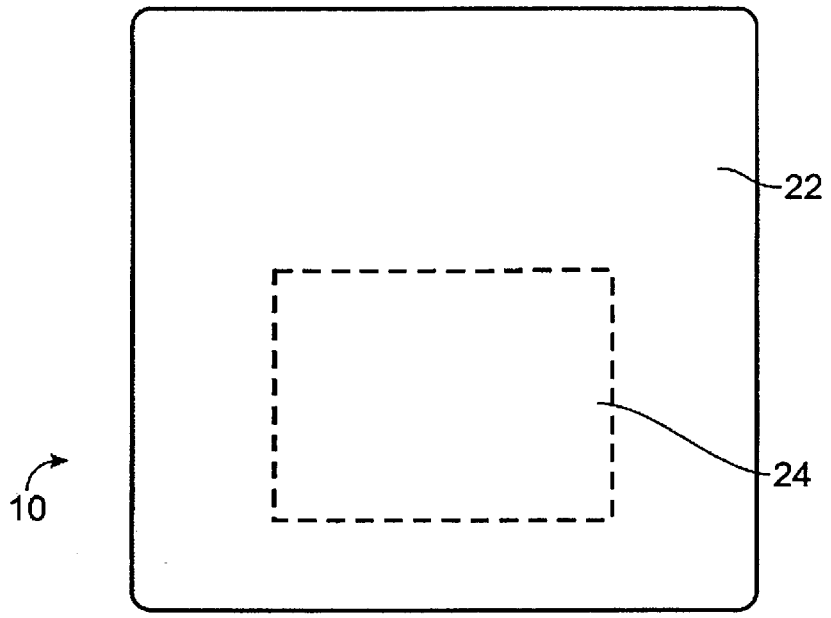
FIG. 1 is a top plan view of a scat cushion according to the present invention.

Conditions related to wheelchair patients in a health care setting revolve primarily around tissue break down, or pressure sores and, secondarily, around comfort. Current methodologies address this problem by using materials that reduce pressure in the highly susceptible areas of the body, primarily in bony areas. These areas include the sacrum/coccyx and ischial tuberosity.

Materials currently used to deal with these problems are soft rubber air cells pneumatically interconnected, conforming harder shells with encased gel material for tissue contact, and different foam densities to match the contours of the body.

Two types of wheelchair cushion systems effect the performance of the cushions. The first is an "active" system. An active system is interconnected so when pressure is applied in one area, the internal substance (usually air) can move away and fill other areas of the cushion. This allows the cushion to evenly distribute the applied pressure. These cushions usually have rubber projections of different heights to help match the contours of the body.

The second type of system used in wheelchair design is called a "passive" system. A "passive" system is not interconnected. The applied pressure is transferred into the material and disburses away from the tissues. These cushions have a variety of designs using material combinations of gel, foam and plastics.

To understand the effects of these two systems, one must study them in both static and dynamic settings. Barometric and atmospheric pressure changes influence active systems. Cases reported state that the change of pressure, while flying, has created pressure sores on wheelchair bound people on active air cushions. Active systems also have a rebound effect when increased forces are transmitted into the system. This occurs because the response of air or fluid to a force is to take the path of least resistance (away from the force) until the air/fluid meets its container's limits. Once this limit is reached, the air/fluid is then sent back until it reaches its limits again. This continues until the force drops below inertia. This process can create high, unstable intermittent pressures at the surface of the cushion, which causes higher pressure points and a shearing effect.

Passive systems have lacked the correct configuration to internally compensate for the differences of body shape and the dynamic forces that a cushion endures. Prior art products focus primarily on pressure reduction, which reduces the ability of the cushion to compensate by reducing the overall contact surface of the cushion.

Bouncing and postural shifting is common in the everyday life of an active wheelchair person. This activity (dynamic setting) creates a variety of increased pressures and forces to which the wheelchair cushions must adjust.

Research Methods

Applicant has conducted a number of studies relating to wheelchair cushion designs using both static and dynamic testing with the use of pressure mapping technologies and outcome research methods. Static testing has been the standard of the industry for evaluating wheelchair cushion effectiveness. There is very little reference research on wheelchair cushion design and effectiveness. The manufacturers of products internally produce most studies.

Different wheelchair cushions were compared using the statistical method, analysis of variance. The analysis of variance method allowed a true scientific statistical comparison of the effectiveness of the different wheelchair cushions. A ROHO high profile wheelchair cushion was used as the clinical standard due to its wide use in healthcare facilities to treat pressure sores. ROHO usage was in accordance with the operations manual. Five seat cushion designs were tested by seven subjects in the first group (Table 1, test 1). Six seat cushion designs were tested by 11 subjects in the second group (Table 2,test 2). Both test groups used Sensing Array Computer Pressure Mapping System (FSA). The seat cushions that were tested by each group are as follows:

Wheelchair without an added scat cushion.

DermaSafe® One Inch PrcssureSoft™ Cushion.

DermaSafe® Two Inch PressureSoft™ Cushion.

DermaSafe® DecubitisCare Wheelchair Cushion.

Roho Wheelchair Cushion.

The second group also tested PressureSoft™ Comfort wheelchair cushions to the testing.)

TABLE 1

Test 1
Demographics Of Seven Subjects:

| ID | Sex | Age | Height Inches | Weight Lbs. | BMI | BSA | LBM |
|---|---|---|---|---|---|---|---|
| 1 | F | 69 | 65 | 147 | 24.55 | 1.73 | 66.3% |
| 2 | F | 33 | 66 | 140 | 22.68 | 1.71 | 69.7% |
| 3 | F | 68 | 64 | 190 | 32.73 | 1.91 | 59.6% |
| 4 | F | 43 | 66 | 150 | 24.3 | 1.76 | 68.7% |
| 5* | M | 45 | 73 | 161 | 21.32 | 1.96 | 86.2% |
| 6 | M | 84 | 68 | 145 | 22.13 | 1.77 | 85% |
| 7 | F | 48 | 61 | 100 | 18.96 | 1.4 | 78.2% |

*Important to note that this subject developed a Stage 2 ulcer within 24 hours of admission to a hospital with injuries sustained from an auto accident.

TABLE 2

Test 2
Demographics Of Eleven Subjects:

| ID | Sex | Age | Height Inches | Weight Lbs. | BMI | BSA | LBM |
|---|---|---|---|---|---|---|---|
| WCTEST1 | F | 34 | 64 | 135 | | | 74.1% |
| WCTEST2 | F | 43 | 64.5 | 130 | | | 68.1% |
| WCTEST3 | M | 37 | 74 | 185 | | | 82.7% |
| WCTEST4 | F | 15 | 68 | 150 | | | 72.3% |
| WCTEST5 | F | 46 | 65 | 188 | | | 57.7% |
| WCTEST6 | F | 24 | 61 | 165 | | | 59.2% |
| WCTEST7 | M | 41 | 70 | 208 | | | 70.9% |
| WCTEST8 | F | 24 | 60 | 160 | | | 60.7% |
| WCTEST9 | F | 44 | 69 | 160 | | | 67.2% |
| WCTEST10 | M | 64 | 73 | 220 | | | 74.6% |
| WCTEST11 | F | 49 | 61 | 100 | | | 73.4% |

The three most important data sets collected were:

Mean Pressure between the test subject and the wheelchair seat. (Mean Pressure is the average pressure of all points activated on the FSA.)

Maximum Pressure between the test subject and the wheelchair seat. (Maximum Pressure is the average highest pressure point.)

Total Number of Points (sensors) activated, representing the total surface area supported, with a higher number of points representing a greater surface area support. All subjects removed all articles from their pockets and scrub pants were used if needed to eliminate hard seams that cause invalid increased pressure readings. Height, weight, and body composition measurements were taken on all subjects. Pressure measurements were taken while subjects sat randomly on different wheelchair cushions.

Data was collected and averaged in each data set (Tables 3 & 5). The data was then rated in each data set with a 1 through 5 or 6 rating. 1 being the highest rating and 5 or 6 being the lowest rating. Then each data set rating was averaged to give an overall rating of each wheelchair cushion tested (Tables 4 & 6). Both data sets combined give a final rating of the first and second test performed (Table 7 and graph 1). Graph 2 represents the percent difference between the wheelchair cushions tested.

TABLE 3

| First Test | No. of Sensors Activated | Ave. Pressure | Max. Pressure |
|---|---|---|---|
| Total Of Test Results | | | |
| Decubicare | 122.1 | 25.4 | 60 |
| DS Comfort | Not Tested | 0 | 0 |
| ROHO | 112.8 | 27.4 | 73.5 |
| 2" PressureSoft ™ | 117.3 | 24.5 | 67 |
| 1" PressureSoft ™ | 111.5 | 25.3 | 72 |
| Wheelchair Only | 103.4 | 24.5 | 80.4 |

TABLE 4

| First Test | No. of Sensors Activated | Ave. Pressure | Max. Pressure | Average Rating |
|---|---|---|---|---|
| Total Of Test Results | | | | |
| Wheelchair Only | 2 | 5 | 5 | 4 |
| 1" PressureSoft ™ | 3 | 3 | 4 | 3.6 |
| 2" PressureSoft ™ | 1 | 2 | 2 | 1.6 |
| DS Comfort | Not Tested | 0 | 0 | 0 |
| Decubicare | 4 | 1 | 1 | 1.6 |
| ROHO | 5 | 4 | 3 | 4 |

TABLE 5

| Second Test | No. of Sensors Activated | Ave. Pressure | Max. Pressure |
|---|---|---|---|
| Total Of Test Results | | | |
| Decubicare | 133 | 24.3 | 64.5 |
| DS Comfort | 128 | 24.6 | 64.4 |
| ROHO | 126 | 24.8 | 67.4 |
| 2" PressureSoft ™ | 125 | 23.8 | 68.3 |
| 1" PressureSoft ™ | 114 | 25.1 | 67.3 |
| Wheelchair Only | 102 | 25.2 | 109.2 |

TABLE 6

| Second Test | No. of Sensors Activated | Ave. Pressure | Max. Pressure | Average Rating |
|---|---|---|---|---|
| Total Of Test Results | | | | |
| Wheelchair Only | 6 | 6 | 6 | 6 |
| 1" PressureSoft ™ | 5 | 5 | 3 | 4.3 |
| 2" PressureSoft ™ | 4 | 1 | 5 | 3.3 |
| DS Comfort | 2 | 3 | 1 | 2 |
| Decubicare | 1 | 2 | 2 | 1.6 |
| | 3 | 4 | 4 | 3.6 |

TABLE 7

| Total of Test Results | Average Rating | Average Rating | Total Rating Both Test | Ranking |
|---|---|---|---|---|
| | Test 1 | Test 2 | | |
| Wheelchair Only | 4 | 6 | 3.0 | 5 |
| 1" PressureSoft ™ | 3.6 | 4.3 | 2.15 | 4 |
| 2" PressureSoft ™ | 1.6 | 3.3 | 1.65 | 2 |
| DS Comfort | 0 | 2 | | |
| Decubicare | 1.6 | 1.6 | 1.60 | 1 |
| ROHO | 4 | 3.6 | 2 | 3 |

Figure 2:
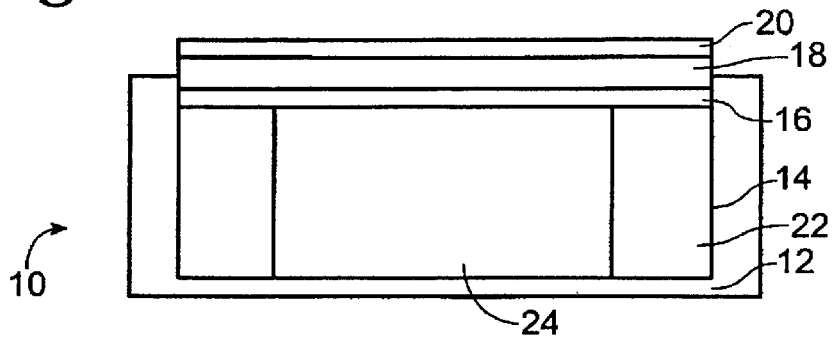
FIG. 2 is a cross-sectional front view of a seat cushion according to the present invention.
Figure 3:
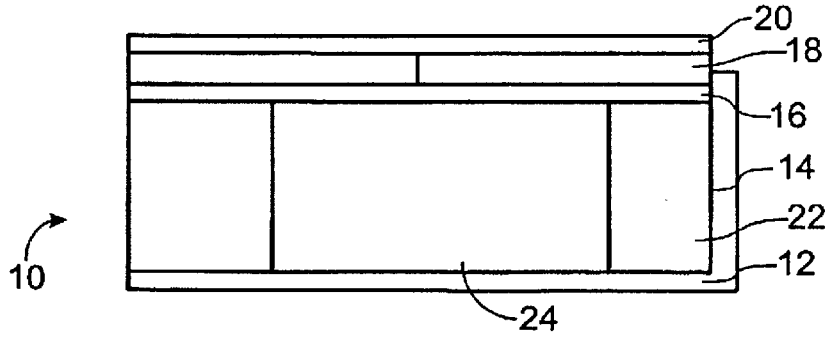
FIG. 3 is a cross-sectional side view of a seat cushion according to the present invention.

Turning now to FIGS. 1–3, a seat cushion according to the present invention is shown generally at 10. Seat cushion 10 includes a foam support layer 12, a first composite conforming layer 14, a first abrasion resistant layer 16, a second conforming layer 18, and a second abrasion resistant layer 20. First composite conforming layer 14 includes an outer portion 22 and an inner portion 24, which is offset toward the rear of the seat cushion as shown in phantom in FIG. 1. In one preferred embodiment, foam support layer 12 is preferably formed from a Zote foam having a density of about 3 pounds per cubic foot, and is about ¼ inch thick. First composite conforming layer 14 is preferably 2 ½ to 3 inches thick. First conforming layer is preferably formed of a highly resilient, open cell, temperature softening, urethane foam, such as that sold as CONFORM® by EAR Specialty Composites Corporation. According to the invention, layer 14 includes two portions having different densities selected to accommodate the different pressures exerted on different portions of the seat cushion. Portion 22 is preferably formed of a resilient foam having a density of about 2.4 pounds/cubic foot. Portion 24 is preferably formed of a foam having a density of about 5.8 lb/ft3 and which has a tensile strength (ASTM 3574) of about 14.6 @ 20 in/min @ 22 C. Layer 18 is preferably formed of a foam having a density of about 5.8 lb/ft3 and which has a tensile strength (ASTM 3574) of about 14.6 @ 20 in/min @ 22 C . In an alternative embodiment, layer 18 is one inch thick, and is divided into front and back halves. The front half is formed of a foam having a density of about 5.7 lb/ft3 and which has a tensile strength (ASTM 3574) of about 18.1 @ 20 in/min @ 22 C. The rear half is formed of a foam having a density of about 5.8 lb/ft3 and which has a tensile strength (ASTM 3574) of about 14.6 @ 20 in/min @ 22 C . In each preferred embodiment, abrasion resistant layers 16 and 20 are formed of a foam having a density of about 2.3 pounds per cubic foot.

Applicant has discovered that use of a seat cushion constructed in the manner described maximizes surface contact to provide a substantially uniform pressure against the body of the user. The foam comprising each region has a stiffness selected to maximize the contact between the seat cushion and the user's body, and to exert a substantially uniform pressure against the user's skin. By so doing, the user is supported in such a way that the likelihood of tissue trauma and dccubitus ulcers is minimized.

Use of conforming foam according to the present invention provides increased contact area, and reduced overall pressure on the tissues. Applicant has also discovered however, that a seat cushion according to the present invention enables tissues to tolerate higher mean pressures than taught in the prior art. It is believed that this unanticipated, additional pressure tolerance of tissues supported according to the present invention is the result of reduced body shear.

It is widely appreciated lying or sitting compresses the supporting tissues. In addition, however, the tissue is also subjected to shear forces when the compressed tissue is deformed outwardly. This shearing action further traumatize the tissue, and renders it more susceptible to pressure sores. Highly resilient, non-conforming foam causes high levels of tissue deformation and high body shear forces. Applicant has discovered that the use of open cell, temperature softening, urethane foam according to the present invention provides the heretofore unappreciated benefit of reducing shear forces.

The foregoing description of the preferred embodiment is intended to be illustrative, and not exclusive. It is understood that those skilled in the art could modify the foregoing embodiment without departing from the scope and spirit of the following claims.

What is claimed is:

1. A seat cushion for reducing the occurrence of decubitus ulcers comprising:

a first layer formed of a first foam material, the first foam material being conformable to a person's body responsive to increased temperature and pressure for exerting a uniform, non-shearing support of the person;

the first layer having a plurality of transverse regions, including a first region positioned to support the person's lower lumbar gluteal region, and a second region positioned to support the person's thighs;

each said transverse region having a stiffness selected to maximize the contact between said foam and the user's skin, and to exert a substantially uniform pressure against the skin of the person;

said first region having a density of between about 5.0 and 6.0 lb/ft$^3$ and an ASTM® D3574 tensile strength of about 14.6 @ 20 in/minute @ 22° C.;

said second region having a density of about 2.4 lb/; and a second layer atop the first layer and having a density of between about 5.0 and 6.0 and an ASTM® D3574 tensile strength of about 14.6 @ 20 in/minute @ 22° C.

2. A seat cushion according to claim 1 wherein said first layer comprises a temperature softening, open cell polyurethane foam.

3. A seat cushion according to claim 1 which further comprises a third abrasion resistant layer adjacent the first layer, and a fourth abrasion resistant adjacent the second layer.

4. A seat cushion according to claim 1 which further comprises a supporting foam layer adjacent the first layer.

5. A seat cushion for reducing the occurrence of decubitus ulcers comprising:

a first layer formed of a first foam material, the first foam material being conformable to a person's body responsive to increased temperature and pressure for exerting a uniform, non-shearing support of the person;

the first layer having a plurality of transverse regions, including a first region positioned to support the person's lower lumbar gluteal region, and a second region positioned to support the person's thighs;

each said transverse region having a stiffness selected to maximize the contact between said foam and the user's skin, and to exert a substantially uniform pressure against the skin of the person;

said first region having a density of between about 5.0 and 6.0 lb/ft$^3$ and an ASTM® D3574 tensile strength of about 14.6 @ 20 in/minute @ 22° C.;

said second region having a density of about 2.4 lb/; and a second layer atop the first layer and having a front portion having a density of between about 5.0 and 6.0 and an ASTM® D3574 tensile strength of about 18.1 @ 20 in/minute @ 22° C., and a rear portion having a density of between about 5.0 and 6.0 lb/ft$^3$ and an ASTM® D3574 tensile strength of about 14.6 @ 20 in/minute @ 22° C.

6. A seat cushion according to claim 5 wherein said first layer comprises a temperature softening, open cell polyurethane foam.

7. A seat cushion according to claim 5 which further comprises at least one abrasion resistant layer adjacent the second layer.

8. A seat cushion according to claim 5 which further comprises a supporting foam layer adjacent the first layer.

* * * * *